United States Patent [19]

Doerner

[11] 4,253,632

[45] Mar. 3, 1981

[54] BASE PORTION FOR TILTABLE CHAIR

[76] Inventor: Frank Doerner, 138 Aberdeen Rd., Kitchener, Ontario, Canada, N2M 2Y7

[21] Appl. No.: 941,008

[22] Filed: Sep. 11, 1978

Related U.S. Application Data

[63] Continuation-in-part of Ser. No. 803,963, Jun. 6, 1977, abandoned.

[30] Foreign Application Priority Data

Apr. 21, 1978 [CA] Canada ..... 301702

[51] Int. Cl.[3] ..... F16M 11/00

[52] U.S. Cl. ..... 248/405

[58] Field of Search ..... 248/161, 371, 405, 406

[56] References Cited

U.S. PATENT DOCUMENTS

| | | | |
|---|---|---|---|
| 2,999,665 | 9/1961 | Erickson et al. | 248/405 |
| 3,161,396 | 12/1964 | Anderson | 248/405 |
| 3,186,669 | 6/1965 | Buhrmaster | 248/188.7 X |
| 3,391,893 | 7/1968 | Doerner | 248/405 |
| 3,406,939 | 10/1968 | Doerner | 248/405 |
| 3,439,893 | 4/1969 | Paquette | 248/405 |
| 3,499,625 | 3/1970 | Froedge | 248/188.7 |
| 3,778,014 | 12/1973 | Driscoll et al. | 248/406 |
| 3,923,280 | 12/1975 | Good | 248/405 |
| 4,181,280 | 1/1980 | Bowman | 248/405 |

FOREIGN PATENT DOCUMENTS

| | | | |
|---|---|---|---|
| 717336 | 9/1965 | Canada . | |
| 800375 | 12/1968 | Canada . | |
| 962936 | 2/1975 | Canada | 248/405 |
| 988834 | 5/1976 | Canada . | |

*Primary Examiner*—William H. Schultz

*Attorney, Agent, or Firm*—George H. Riches and Associates

[57] ABSTRACT

A novel base portion for a tiltable chair. The base portion comprises a chair control adapted to control the tilting of the chair, a threaded cylindrical post secured to the chair control and extending vertically downward, an outer, vertically aligned tubular sleeve around the cylindrical post, a bell assembly mounted on the cylindrical post above the tubular sleeve and adapted to control the height of the chair, an alignment means adapted to align the tubular sleeve in a vertical position relative to the cylindrical post with the alignment means mounted on the cylindrical post inside the tubular sleeve, and a plurality of radially extending legs adapted to support the chair with their inner ends secured to the alignment means.

13 Claims, 7 Drawing Figures

FIG.1.
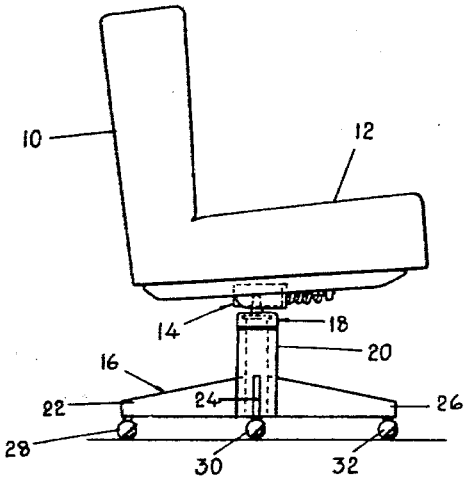
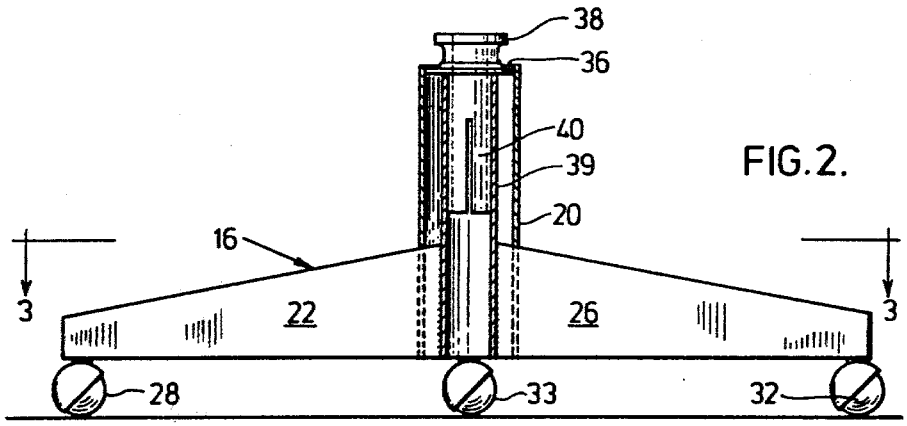
FIG.2.
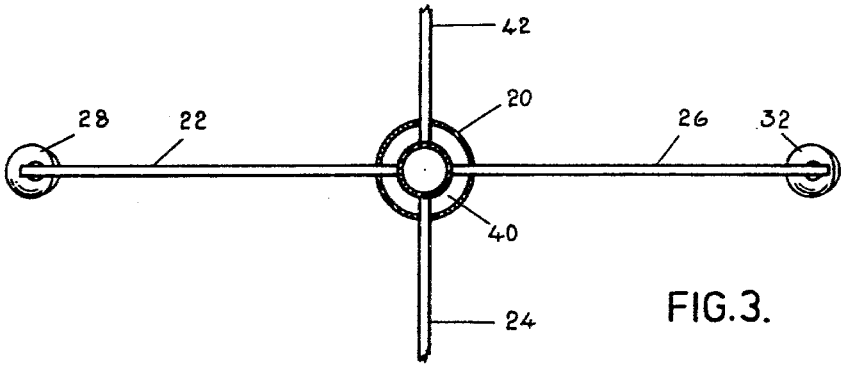
FIG.3.

BASE PORTION FOR TILTABLE CHAIR

CROSS-REFERENCE TO RELATED APPLICATION

This application is a continuation-in-part application of my U.S. patent application Ser. No. 803,963 filed on June 6, 1977, now abandoned.

BACKGROUND OF THE DISCLOSURE

1. Field of the Invention

This invention relates generally to tiltable chairs and more specifically to a novel base portion for tiltable chairs.

2. Description of the Prior Art

The tiltable chairs of the prior art usually comprise a seat and back portion as one unit, a chair control to control the tilting of the chair, and a base portion which includes a plurality of legs extending from a central portion radially outwards with wheels or casters on the peripheral ends of the legs. The legs of the chair converge to a central vertical post assembly which provides a link between the legs and the chair control itself. This central post assembly by its construction, allows the chair seat to swivel about the legs and also allows the seat of the chair to be raised or lowered according to the user's requirements.

The post assembly found in some chairs of the prior art consist essentially of a cylindrical threaded post, the upper portion of which is secured through a central opening to the chair control itself or to the underneath surface of the chair seat, and a tubular sleeve, the lower end of which is affixed to the inner ends of each leg and which fits over the cylindrical threaded post. A bell assembly is adjustably secured around the cylindrical post above the uppermost portion of the tubular sleeve.

The tubular sleeve of the prior art consists of a tube which is placed over the threaded post and the lower end of the tube includes vertical slots cut therein. The slots correspond to the number and position of the legs of the chair and the tube is constructed so that each leg of the chair fits into a corresponding slot. The tube and the legs are then welded together.

In most of these prior art devices, no means to align the tube in the vertical position relative to the post is provided. Once the sleeve is welded, it remains in that position. Thus, if the sleeve is not aligned vertically when it is welded, the assembly will be off centre. In these chairs of the prior art, it was therefore a painstakingly slow and cumbersome job to align the tube perfectly vertical relative to the cylindrical post prior to welding. If the tube was not aligned or if the fabricator did not take sufficient time and effort to align the tube, an assembly would be produced of inferior quality in both appearance and in utility.

In another embodiment of the prior art, an inner tubular sleeve was mounted directly on the threaded cylindrical post to effect vertical alignment of the post with the base portion. However, to achieve a secure fit with the post, the tolerances of the inner sleeve must be exact and usually, expensive C-drawn tubing was used. More recently, a nylon liner has been used to secure the inner tubular sleeve to the post. However, with these constructions, the inner tubular sleeve must still be of exact tolerances to create a tight fit and accordingly expensive tubing was still required.

With these devices of the prior art using the inner tubular sleeve, the inner ends of the legs of the chair were affixed to the lower portion of the sleeve by welding or similar means instead of relying on the outer sleeve to align the legs correctly.

The bell assembly of the prior art chairs was also a cumbersome device. The bell portion was inserted on the threaded cylindrical post and screwed downward to a point above the outer tubular sleeve. A washer was placed on the threaded post above the tubular sleeve. The bell assembly included a screw which was inserted through the vertical side wall of the bell and was screwed inwards below or underneath the washer and in contact with the threaded central post.

Thus, when the chair seat was rotated in one direction, (with the bell assembly stationary) the interior threaded post would rotate and screw itself upwards and raise the chair seat but only until the screw in the bell assembly engaged itself with the underneath portion of the washer. When the chair seat was rotated in the opposite direction, the central threaded post would screw itself downwards until the top portion of the washer engaged itself with the inner surface of the top horizontal surface of the bell.

In order to adjust the movement and the height of the chair seat and back, the screw must be loosened and the bell assembly raised. The washer was then adjusted either upwards or downwards and then the bell assembly was reassembled over the washer and the screw tightened. Also, to disassemble the assembly, the screw must be loosened and removed and the threaded post is screwed upwards and removed from the assembly.

A further example of the construction of the assembly of the prior art is shown in U.S. Pat. No. 3,185,430 granted on May 25, 1965 to C. H. M. Bernard. This device utilizes a helical spring and a threaded post to allow the height of the chair seat to be adjusted.

The devices of the prior art have many problems associated therewith. In particular, the assemblies have been rather complicated to manufacture and thus add a considerable cost to the production of the chair. The inclusion of the screw in the assembly and its mode of operation necessitates tools for assembly and disassembly which does not allow for quick and efficient adjustment by the user of the chair. The adjustment of the assembly becomes a complicated procedure which does not lend itself to easy serviceability.

Also, the tubular sleeve of the base assembly is not always mounted in the vertical position when the chair is assembled. This can result from poor welding techniques or not taking sufficient care in the assembly stage. It is particularly difficult to align the tube vertically with respect to the post and hold it there during welding without additional expensive equipment.

Thus, when the assemblies are made in the prior art, the tubular sleeve is not always vertically aligned which detracts significantly from the operation and appearance of the chair.

Also, when an inner tubular sleeve was used with the devices of the prior art, expensive C-drawn tubing was always required to achieve a good fit with the threaded post, thereby increasing the cost of the manufacture of the chairs.

SUMMARY OF THE INVENTION

Accordingly it is an object of the present invention to at least partially overcome these disadvantages by providing a novel base portion for a tiltable chair which includes an alignment means to align the tubular sleeve in a vertical position in an efficient manner as well as providing a novel bell assembly to facilitate easy adjustment and service of the chair.

To this end, in one of its aspects, the invention provides a base portion for a tiltable chair, the portion comprising:

(a) a chair control adapted to control the tilting of said chair;
(b) a threaded cylindrical post secured to said chair control and extending vertically downward;
(c) an outer, vertically aligned tubular sleeve around said cylindrical post;
(d) a bell assembly mounted on said cylindrical post above said tubular sleeve, said assembly adapted to control the height of said chair;
(e) an alignment means adapted to align said tubular sleeve in a vertical position relative to said cylindrical post, said alignment means mounted on said cylindrical post inside said tubular sleeve; and
(f) a plurality of radially extending legs adapted to support said chair, the inner ends of said legs secured to the lower portion of said alignment means.

In another of its aspects, the invention further provides a base portion for a tiltable chair which comprises:

(a) a chair control adapted to control the tilting of said chair;
(b) a threaded cylindrical post secured to said chair control and extending vertically downward;
(c) an outer, vertically aligned tubular sleeve around said cylindrical post, said sleeve extending approximately three-quarters the length of said post;
(d) an alignment means adapted to align said tubular sleeve in a vertical position relative to said cylindrical post, said alignment means mounted on said cylindrical post inside said tubular sleeve, said alignment means comprising:
  (i) a first inner, resilient, plastic tubular sleeve mounted on said cylindrical post;
  (ii) a second inner tubular sleeve mounted on said first inner tubular sleeve;
  said first inner sleeve having a circular flange marginally below the top surface thereof, the diameter of said flange being less than the diameter of said outer tubular sleeve, and a circumferential lip around the top portion of said first inner sleeve, and a pair of diametrically opposed slots cut into the side wall of said first sleeve and extending upwards approximately one-half the length of said sleeve; said second inner sleeve mounted on said first inner sleeve and extending from immediately below said circular flange to the bottom of said cylindrical post;
(e) a plurality of radially extending legs, the inner end of each leg secured to the lower portion of said second inner tubular sleeve;
(f) a bell assembly mounted on said cylindrical post above said first inner tubular sleeve, said assembly adapted to control the height of said chair, said assembly consisting of
  (i) a stainless steel cover having a circular top with a circular opening in the top, the diameter of said opening being marginally greater than the diameter of said cylindrical post;
  (ii) A resilient, plastic joining means comprising an upper disc and a lower disc secured together, the diameter of the upper disc being marginally less than the inner diameter of said cover, the diameter of said lower disc being less than the diameter of said upper disc, the joining means having a central opening which is screw threaded corresponding to the threading of said cylindrical post, the upper disc having four equidistantly spaced vertical holes therein, and the lower disc has four corresponding concave indentations in its vertical wall immediately below each of said holes;
  (iii) a resilient, plastic joining means adapted to secure the joining means to said cover and also adapted to releasably secure said bell assembly to said alignment means, said securing means consisting of a thin, cylindrical member, the diameter of which is approximately equal to the diameter of said upper disc of said joining means, the upper portion of the inner surface of said member carrying a pair of equidistantly spaced grommets corresponding to a pair of said holes in said upper disc of said joining means, and a pair of equidistantly spaced upwardly extending short posts corresponding to said other pair of holes in said upper disc of said joining means, whereby when said joining means is placed over said securing means, the grommets and a pair of holes are aligned and said posts extend upwards and through the other pair of holes and a plurality of alternately large and small equidistantly spaced arch-shaped apertures are cut into the lower portion of said member, with a large aperture below each grommet, and the lower inner surface of said securing means carries an inwardly extending protrusion adapted to secure said means to said alignment means, the lower surface of said protrusion slanted downwardly and outwardly and the upper surface of said protrusion slanted marginally outwardly and upwardly.

BRIEF DESCRIPTION OF THE DRAWINGS

FIG. 1 is a side view of a tiltable chair and base portion of the present invention.

FIG. 2 is a side sectional view showing the novel alignment means of the present invention.

FIG. 3 is a top view along line III—III of FIG. 2.

DESCRIPTION OF THE PREFERRED EMBODIMENT

Figure 4:
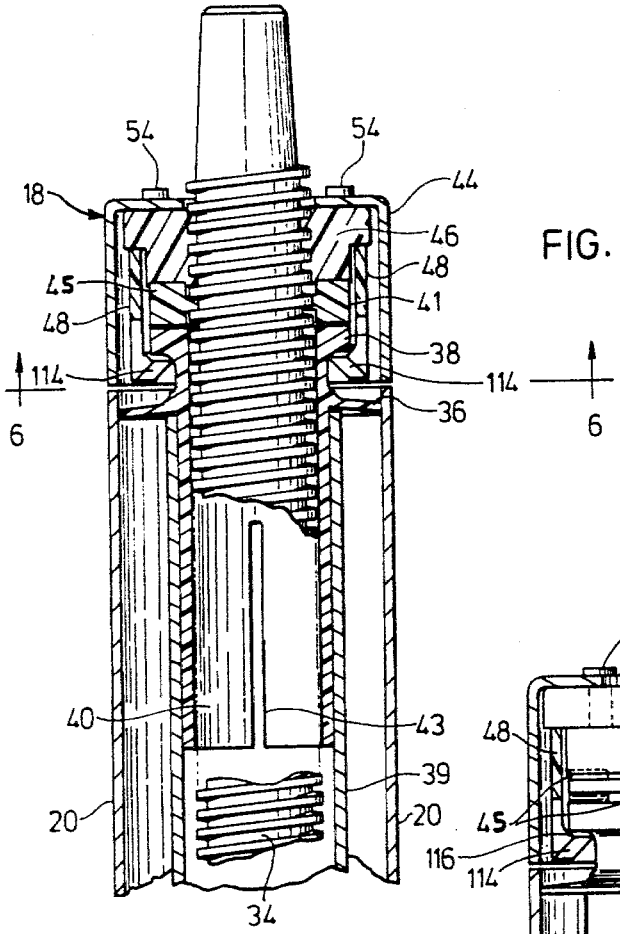
FIG. 4 is a sectional view showing the novel bell assembly and alignment means of the present invention.

Reference is first made to FIG. 1 which shows a chair which comprises a chair back 10, a chair seat 12, a chair control 14 and a base portion generally indicated as 16. The base portion 16 comprises a bell assembly 18, an outer tubular sleeve 20 and legs 22, 24, 26 with casters 28, 30, 32 affixed to the terminal portion of the legs.

With reference to FIG. 2, the base portion 16 includes an outer tubular sleeve 20, a first inner tubular sleeve 40, a second inner tubular sleeve 39, a circular flange 36 mounted on the tubular sleeve 40, and a circumferential lip 38 on the top of the sleeve 40. Legs 22, 24 (not shown) and 26 extend radially outward from the bottom of the tubular sleeve 20 and casters 28, 32, 33 are shown affixed to the terminal portion of the legs. The number of legs may vary as well as the casters affixed thereto.

Referring now to FIG. 4, there is shown the novel post and bell assembly of the present invention. The bell assembly 18 consists of three co-operating parts: a cover 44, a joining means 46 and a securing means 48.

The threaded cylindrical post 34 is affixed to the undersurface of the chair seat 12 or to the chair control 14 (see FIG. 1). A first inner tubular sleeve 40 is placed around the post 34 with the circular flange 36 on the first inner tubular sleeve marginally below the plane of the upper end of the outer tubular sleeve 20. The flange 36 aligns the outer tubular sleeve 20 in a vertical position with respect to the central post. Thus, the upper part of the tubular sleeve is always vertically aligned with respect to the post and one of the drawbacks of the prior art assemblies has been overcome. This construction utilizing the alignment flange 36, in conjunction with the legs 22, 24, 26, 42 secures the outer tubular sleeve in the vertical position and improves the appearance of the assembly. The alignment means (sleeve 40) carries a horizontal, circumferential lip 38 on its top portion.

Once the first inner tubular sleeve 40 is mounted on the post 34, a second tubular sleeve 39 is mounted on the first tubular sleeve. This second sleeve 39 extends from immediately below the flange 36 downward to the legs of the chair.

To assemble the construction, the first tubular sleeve 40 is pressed into the second inner sleeve 39. However, the inventor has found that the tubing from which the sleeve 39 is produced is not of the same inner diameter every time thereby causing problems when the first inner sleeve is pressed into the second inner sleeve. If the tolerances of the second inner sleeve are not exact, then a loose fit about the central post is created is the diameter is too large, and if the diameter is too small, the second inner sleeve will not fit around the post, and accordingly, an unacceptable construction. In order to obtain a perfect fit, it has been necessary to produce the second inner sleeve from C-drawn tubing which is quite expensive although exact in tolerances.

The inventor has discovered that by the use of the first inner sleeve, the tolerances of the second sleeve are not required to be exact thereby allowing the fabricator to use tubing of approximately one-third the price.

In order to achieve the necessary tight fit, the first sleeve 40 contains a pair of slots 43 in the lower portion of the sleeve 40. When the sleeve 40 is pressed into the second inner sleeve 39, the compression of the diameter of the first sleeve 40 (as a result of the slots and the accompanying resiliency) produces a tight fit no matter what the tolerances of the second sleeve 39 are.

The slots 43 in the first inner sleeve 40 allow for tolerances in the size of the second sleeve 39 which have not been accounted for in the past. As a result, the second inner sleeve 39 may be manufactured from commercial tubing which costs about one-third the cost of the C-drawn tubing.

The only portion of the first inner sleeve 40 under pressure is the uppermost part which maintains the frictional contact with the second inner sleeve 39.

The first inner sleeve 40 is made preferably of nylon although it is not restricted thereto. The use of nylon improves the contact between the first and second inner sleeves and prevents any metal to metal damage which might otherwise occur. By using the nylon hub, any variations in the manufacturing of the commerical tubing used as the second sleeve 39 are compensated.

Once the sleeves are mounted on the post, adjusting washer 41 may be placed on the post immediately above the lip 38.

Figure 5:
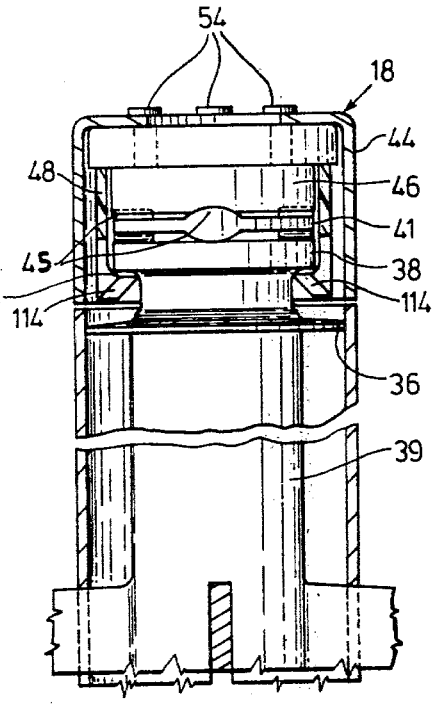
FIG. 5 is a side sectional view showing the alignment means and bell assembly of the present invention.

FIG. 5 shows the construction of FIG. 4 including the second inner sleeve 39. Sleeve 39 is inserted over the first inner sleeve 40 (not shown) and the alignment flange 36 aligns the outer tubular sleeve 20 in a vertical position. The bell assembly 18 consists of the cover 44, joining means 46 and securing means 48. Once assembled, bolts or rivets may be used to secure the three co-operating parts of the bell assembly.

Figure 7:
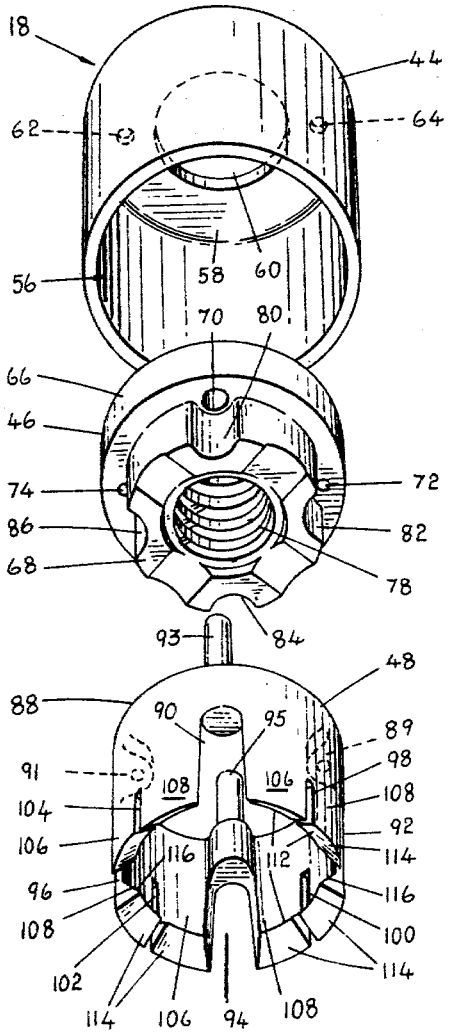
FIG. 7 is an exploded perspective view of the bell assembly of the present invention.

FIG. 7 is an exploded view of the bell assembly of the present invention. Cover 44 is bell shaped and has an open bottom surface 56 and a closed top portion 58 except for a small central opening 60. Two small holes 62, 64 are cut in the top surface aligned on a diameter line of the top surface 58. The central opening 60 is of a marginally greater diameter than the diameter of the cylindrical post 34 so that the cover fits on the post.

The joining means 46 of the bell assembly 18 comprises an upper disc 66 and a lower disc 68. The upper disc 66 has a substantially flat top surface with vertical side walls. The diameter of the upper disc is marginally less than the inner diameter of the cover 44 so that the joining means 46 fits within the cover 44. Four vertical holes 70, 72, 74, 76 (76 is not shown in FIG. 7) are cut vertically through the upper disc 66. Each hole is spaced equally from each adjacent hole and in a preferred embodiment, and opposite holes 70, 76 are larger than holes 72, 74. An opening 78 is screw-threaded and appears centrally in the joining means 46.

The lower disc 68 is approximately the same height as the upper disc 66. It is circular (bottom view) in shape except for four concave indentations 80, 82, 84, 86 are cut into the vertical wall immediately below each of the holes 70, 72, 74, 76. These indentations run the height of the side wall of the lower disc 68 and are approximately equal in size.

Figure 6:
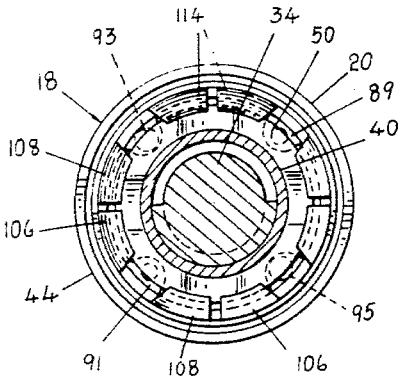
FIG. 6 is an underneath view along line VI—VI of FIG. 4.

The third part of the bell assembly is the securing means 48. It is a thin, cylindrical member 88, the diameter of which is approximately equal to the diameter of the upper disc of the joining means. The inner upper surface of the member 88 carries a pair of equidistantly spaced grommets 89, 91, corresponding to a pair of the holes in the upper disc of the joining means and a pair of equidistantly spaced upwardly extending short posts 93, 95 corresponding to the other pair of holes in the upper disc of the joining means. When the joining means is placed over the securing means (see FIG. 6), the grommets and a pair of holes are aligned and the posts extend upwards and through the other pair of holes.

A plurality of arch-shaped apertures are cut in the side wall of the securing means. In an embodiment of FIG. 7, four large apertures 90, 92, 94, 96 are equidistantly spaced around the periphery of the member 88 with smaller arch-shaped apertures 98, 100, 102, 104 between each respective large aperture.

As seen from FIG. 7, the arrangement of the apertures (90 to 104) form a pair of feet 106, 108 between each pair of apertures 90, 92; 92, 94; 94, 96; 96, 90. The lower inner surface of the securing means carries an inwardly extending protrusion 112 and the protrusion 112 is situated marginally above the lowermost plane of the feet 106, 108. The surface 114 of the protrusion 112 to the bottom of the feet is slanted and the surface 116 from the top of the protrusion to the inner surface of the feet is slanted marginally upwards.

As noted before, on the upper portion of the inner vertical surface of securing means 48, two vertical short posts 93, 95 extend upwards from the top surface of the securing means above two of the large apertures. These posts 93, 95 are adapted to fit within indentations 80, 84 and fill the holes 70, 76 respectively. Grommets 89, 91 are secured to the inner surface of the member 88 above the other two large apertures. The hole cut centrally through the grommet is the same size as small holes 72, 74.

When the bell assembly is assembled, and posts 93, 95 are inserted into holes 70, 76 (76 not shown) the other holes 72, 74 are aligned with the holes in the grommets 89, 91.

The cover of the bell assembly 18 may be manufactured of chrome or stainless steel to enhance the appearance thereof. Joining means 46 and securing means 48 may be manufactured of any resilient material (e.g. plastic) which will give sufficient strength to the structure and is light weight. Being manufactured of a resilient material, the securing means 48 possesses a certain degree of flexibility and the feet 106, 108 may be flexed marginally inwardly or outwardly and return to their original position without breakage. This resiliency is particularly important as will be explained hereinafter.

The mode of operation of the base portion will now be explained with particular reference to FIGS. 2 and 4 to 7.

In the construction of the base portion of the tiltable chair, the second inner tubular sleeve 39 of the alignment means is secured to legs 22, 24, 26 and 42 at the bottom thereof. The first inner tubular sleeve 40 is pressed into the second inner tubular sleeve 39 while flange 36 rests in the top of the second inner tubular sleeve 39. Outer tubular sleeve 20 is then placed over the inner sleeve 40 and flange 36, and is secured (e.g. by welding) to the legs as in the manner described hereinbefore. The circular flange 36 on the tubular sleeve 40 aligns the outer sleeve 20 in a vertical position with respect to post 34 thus insuring the position of the sleeve 20 after it is welded to the legs of the chair.

The threaded tubular post 34 is then inserted into the first inner tubular sleeve 40 and washer 41 placed on the post. The bell assembly (FIG. 7) is then assembled by inserting posts 93, 95 into holes 70, 76 and placing the combined securing means and joining means into the cover 44. Rivets 54 (see FIG. 5) are inserted through holes 62, 64 in the cover 44 and through the holes 72, 74 of the joining means and into grommets 89, 91 of the securing means. The tops of the rivets 54 may be heat sealed to improve the appearance of the bell assembly.

The bell assembly is then placed on the cylindrical post 34 and screwed downward to the desired position. The cylindrical post cannot be inserted any further into the sleeve 40 when surface 114 contacts the circumferential lip 38. However, sharp downward pressure is then applied to the post and by a combination of the angle of the surface 114, and the resiliency inherent in the substance from which it is manufactured, the feet 106, 108 spread outwardly thereby passing downward of lip 50. Once the feet 106, 108 pass lip 50, they spring back to their original position.

To adjust the height of the chair, either the chair seat is rotated and the bell assembly held stationary or the bell assembly is rotated and the chair seat is held stationary. In either case, the cylindrical post then turns either up or down through the bell assembly raising or lowering the chair seat. This raising or lowering of the chair seat will occur until one end or the other of the thread of the threaded post is reached on the desired height.

To disassemble the assembly, the bell is screwed upwards until surface 116 contacts the underneath surface of lip 38. Again, because of the slant of surfaces 116 and the resiliency of the feet 106, 108, a sharply applied upward pressure will cause the feet 106, 108 to move outward and allow the post to be removed.

It is noted that the surface 114 is slanted at a greater angle than surface 116. Thus, a much greater pressure is required to disassemble the assembly than to assemble same. This prevents the assembly from accidently disengaging itself in use and provides a safe and much improved mechanism over the prior art. A deliberate effort must be made to separate the components which prevents accidental separation.

The assembly also permits easy and quick adjustment of the height of the chair. The difference in space between the lip 38 and the surface 116 of the feet allows the assembly to be moved up or down on the tubular post to allow minimum adjustment of the height of the chair seat.

When the user desires to make greater changes than this distance allows, the cylindrical post is lifted until surface 116 engages lip 38. While holding the post, the bell assembly is screwed downward until the underneath surface of the joining means engages lip 38.

Thus, the present invention allows for quick and easy assembly and disassembly of the base portion of a tiltable chair. It has eliminated the unsightly screw found on the bell of the devices of the prior art and has also provided a device which may be assembled, disassembled, and adjusted without the need for tools. The device is also relatively easy to manufacture and can be molded at low cost.

The device of the present invention also provides that the tubular sleeve visible to the user is vertically aligned both for improvement of appearance and utility.

In the prior art, the bell assembly has been manufactured of drawn tubing or commercial seam tubing. Exact dimensions were required for the inside diameter of the assembly which increased the time and expense of its manufacture.

The present invention eliminates the need for exact dimensions in that its construction allows increased tolerances. The resilient plastic parts of the bell assembly permit easy assembly and in conjunction with the alignment means, provides a much improved product.

Although the disclosure describes and illustrates a preferred embodiment of the invention, it is to be understood that the invention is not restricted to this particular embodiment.

What I claim is:

1. A base portion for a tiltable chair, said portion comprising:

(a) a chair control adapted to control the tilting of said chair;

(b) a threaded cylindrical post secured to said chair control and extending vertically downward;

(c) an outer, vertically aligned tubular sleeve around said cylindrical post;

(d) a bell assembly mounted on said cylindrical post above said tubular sleeve, said assembly adapted to control the height of said chair;

(e) an alignment means adapted to align said tubular sleeve in a vertical position relative to said cylindrical post, said alignment means mounted on said cylindrical post inside said tubular sleeve, said alignment means comprising:

(i) a first inner resilient, plastic tubular sleeve mounted on said cylindrical post;

(ii) a second inner tubular sleeve mounted on said first inner tubular sleeve;

said first inner sleeve having an integral circular flange marginally below the top surface thereof, the diameter of said flange being less than the diameter of said outer tubular sleeve, and a circumferential lip around the top portion of said first inner sleeve and integral therewith, and a pair of diametrically opposed slots cut into the side wall of said first inner sleeve and extending upwards approximately one-half the length of said sleeve;

said second sleeve mounted on said first inner sleeve and extending from immediately below said circular flange to the bottom of said cylindrical post;

(f) a plurality of radially extending legs adapted to support said chair, the inner ends of said legs being secured to the lower portion of said second inner sleeve.

2. A base portion as claimed in claim 1 wherein said outer, vertically aligned tubular sleeve extends approximately three-quarters the length of the cylindrical post.

3. A base portion as claimed in claim 1 wherein said first inner tubular sleeve is nylon.

4. A base portion as claimed in claim 1 wherein the bell assembly consists of:

(a) a cover having a circular top with a circular opening therein, the diameter of said opening being marginally greater than the diameter of said cylindrical post;

(b) a joining means comprising an upper disc and a lower disc secured together, the diameter of the upper disc being marginally less than the inner diameter of said cover, the diameter of said lower disc being less than the diameter of said upper disc, the joining means having a central opening which is screw threaded corresponding to the threading of said cylindrical post; and (c) a securing means adapted to secure the joining means to said cover and also adapted to releasably secure said bell assembly to said alignment means.

5. A base assembly as claimed in claim 4 where said upper disc of said joining means has four equidistantly spaced vertical holes therein, and the lower disc has four corresponding concave indentations in its vertical wall immediately below each of said holes.

6. A base assembly as claimed in claim 5 wherein said securing means comprises a thin, cylindrical member, the diameter of which is approximately equal to the diameter of said upper disc of said joining means, the upper portion of the inner surface of said member carrying a pair of equidistantly spaced grommets corresponding to a pair of said holes in said upper disc of said joining means, and a pair of equidistantly spaced upwardly extending short posts corresponding to said other pair of holes in said upper disc of said joining means, whereby when said joining means is placed over said securing means, the grommets and a pair of holes are aligned and said posts extend upwards and through the other pair of holes.

7. A base assembly as claimed in claim 6 wherein a plurality of arch-shaped apertures are cut into the lower portion of said member.

8. A base assembly as claimed in claim 7 wherein said apertures are alternately large and small.

9. A base assembly as claimed in claim 8 wherein a large aperture is cut below each grommet.

10. A base assembly as claimed in claim 9 wherein said apertures are equidistantly spaced apart.

11. A base assembly as claimed in claim 10 wherein said cover is made of stainless steel.

12. A base assembly as claimed in claim 11 wherein the inner surface of the lower portion of said securing means carries an inwardly extending protrusion adapted to secure said means to said alignment means, the lower surface of said protrusion slanted inwardly and upwardly and the marginally upper surface of said protrusion slanted inwardly and downwardly.

13. A base portion for a tiltable chair which comprises:

(a) a chair control adapted to control the tilting of said chair;

(b) a threaded cylindrical post secured to said chair control and extending vertically downward;

(c) an outer, vertically aligned tubular sleeve around said cylindrical post;

(d) an alignment means adapted to align said tubular sleeve in a vertical position relative to said cylindrical post, said alignment means mounted on said cylindrical post inside said tubular sleeve, said alignment means comprising:

(i) a first inner resilient, plastic tubular nylon sleeve mounted on said cylindrical post;

(ii) a second inner tubular sleeve mounted on said first inner tubular post;

said first inner sleeve having an integral circular flange marginally below the top surface thereof, the diameter of said flange being less than the diameter of said outer tubular sleeve, and a circumferential lip around the top portion of said first inner sleeve and integral therewith, and a pair of diametrically opposed slots cut into the side wall of said first inner sleeve and extending upwards approximately one-half the length of said sleeve; said second sleeve mounted on said first inner sleeve and extending from immediately below said circular flange to the bottom of said cylindrical post;

(e) a plurality of radially extending legs adapted to support said chair, the inner ends of said legs being secured to the lower portion of said second inner sleeve;

(f) a bell assembly mounted on said cylindrical post above said tubular sleeve, said assembly adapted to control the height of said chair, said assembly consisting of (i) a stainless steel bell-shaped cover having a circular top with a circular opening therein, the diameter of said opening being marginally greater than the diameter of said cylindrical post;

(ii) a resilient, plastic joining means comprising an upper disc and a lower disc secured together, the diameter of the upper disc being marginally less than the inner diameter of said cover, the diameter of said lower disc being less than the diameter of said upper disc, the joining means having a central opening which is screw threaded corresponding to the threading of said cylindrical post, the upper disc having four equidistantly spaced vertical holes therein, and the lower disc has four corresponding concave indentations in its vertical wall immediately below each of said holes;

(iii) a resilient, plastic securing means adapted to secure the joining means to said cover and also adapted to releasably secure said bell assembly to said alignment means, said securing means consisting of a thin, cylindrical member, the diameter of which is approximately equal to the diameter of said upper disc of said joining means, the upper portion of the inner surface of said member carrying a pair of equidistantly spaced grommets corresponding to a pair of said holes in said upper disc of said joining means, and a pair of equidistantly spaced upwardly extending short posts corresponding to said other pair of holes in said upper disc of said joining means, whereby when said joining means is placed over said securing means, the grommets and a pair of holes are aligned and said posts extend upwards and through the other pair of holes and a plurality of alternately large and small equidistantly spaced arch-shaped apertures are cut into the lower portion of said member, with a large aperture below each grommet, and the lower inner surface of said securing means carries an inwardly extending protrusion adapted to secure said means to said alignment means, the lower surface of said protrusion slanted upwardly and inwardly and the upper surface of said protrusion slanted marginally downwardly and inwardly.

* * * * *